US006905524B2

(12) United States Patent
Hartgrove et al.

(10) Patent No.: US 6,905,524 B2
(45) Date of Patent: Jun. 14, 2005

(54) METHOD OF CONTINUOUSLY DYEING NONWOVEN FABRICS AND THE PRODUCTS THEREOF

(75) Inventors: Herbert Hartgrove, Angier, NC (US); Sergio Diaz De Leon, Clayton, NC (US)

(73) Assignee: Polymer Group, Inc., North Charleston, SC (US)

( * ) Notice: Subject to any disclaimer, the term of this patent is extended or adjusted under 35 U.S.C. 154(b) by 80 days.

(21) Appl. No.: 10/289,554

(22) Filed: Nov. 7, 2002

(65) Prior Publication Data

US 2003/0115688 A1 Jun. 26, 2003

Related U.S. Application Data

(60) Provisional application No. 60/345,377, filed on Nov. 9, 2001.

(51) Int. Cl.[7] ..... D06P 3/84; D06P 1/22
(52) U.S. Cl. ..... 8/494; 8/650; 8/653
(58) Field of Search ..... 8/650–653, 494

(56) References Cited

U.S. PATENT DOCUMENTS

| | | | | |
|---|---|---|---|---|
| 3,457,022 A | | 7/1969 | Fields | |
| 3,485,706 A | | 12/1969 | Evans | |
| 5,484,457 A | | 1/1996 | Schulze et al. | |
| 5,611,822 A | | 3/1997 | Gurley | |
| 5,882,359 A | | 3/1999 | Leupin et al. | |
| 6,004,358 A | * | 12/1999 | Kruger et al. | 8/653 |
| 6,022,447 A | | 2/2000 | Radwanski et al. | |

* cited by examiner

*Primary Examiner*—Margaret Einsmann
(74) *Attorney, Agent, or Firm*—Wood, Phillips, Katz, Clark & Mortimer

(57) ABSTRACT

It is the objective of the present invention to disclose a method of continuously dyeing durable nonwoven fabrics, and more specifically, nonwoven fabrics comprising a cellulosic fibrous material dyed with indigo dyestuffs. It is in accordance with the present invention, to utilize synthetic fibers in combination with natural or cellulosic fibers in the formation of a nonwoven web. The natural fibers, preferably cotton, make up at least 10% of the fibrous nonwoven fabric.

6 Claims, 2 Drawing Sheets

METHOD OF CONTINUOUSLY DYEING NONWOVEN FABRICS AND THE PRODUCTS THEREOF

TECHNICAL FIELD

The present invention relates to a method of continuously dyeing nonwoven fabrics, and more specifically, the continuous forming of nonwoven fabrics comprising a cellulosic fibrous material, which are dyed with indigo dyestuffs, such nonwoven fabrics intended for an end use in apparel, bedding, industrial, and other commercial applications.

BACKGROUND OF THE INVENTION

The production of conventional textile fabrics is known to be a complex, multi-step process. The production of fabrics from staple fibers begins with the carding process where the fibers are opened and aligned into a feedstock known as sliver. Several strands of sliver are then drawn multiple times on drawing frames to further align the fibers, blend, improve uniformity as well as reduce the diameter of the sliver. The drawn sliver is then fed into a roving frame to produce roving by further reducing its diameter as well as imparting a slight false twist. The roving is then fed into the spinning frame where it is spun into yarn. The yarns are next placed onto a winder where they are transferred into larger packages. The yarn is then ready to be used to create a fabric.

For a woven fabric, the yarns are designated for specific use as warp or fill yarns. The fiber or yarn packages (which run in the cross direction and are known as picks) are taken straight to the loom for weaving. The warp yarns (which run on in the machine direction and are known as ends) must be further processed. The packages of warp yarns are used to build a warp beam. Here the packages are placed onto a warper, which feeds multiple yarn ends onto the beam in a parallel array. The warp beam yarns are then run through a slasher where a water-soluble sizing is applied to the yarns to stiffen them and improve abrasion resistance during the remainder of the weaving process. The yarns are wound onto a loom beam as they exit the slasher, which is then mounted onto the back of the loom. Here the warp and fill yarns are interwoven in a complex process to produce yardage of cloth.

Coloring and shading are likewise complex processes in conventional textile production. Colors and patterns of color can be achieved by using yarns of various colors, resulting from the dyeing of the fiber or yarn packages themselves. Further, greige goods, yardage produced from undyed yarns, can be dyed in any of several ways common to the industry, such as jet dyeing, and vat dyeing. For application of color and patterns of colors onto the surface of a fabric, printing is commonly used, whereby pigments are applied to the fabrics by a series of engraved screens where each roll applies a specific color and part of the pattern.

Yarns and woven textiles have a history of being dyed with indigo dyestuffs. Indigo dye is a natural vat dye, but the use of natural dye has since diminished given that it has been synthesized. Indigo is called a vat dye as a result of the method of its application. Indigo is treated chemically previous to exposing a material to the dye within a vat. The process for dyeing traditional yarns and textile fabric with indigo is well known and is discussed in prior art U.S. Pat. No. 5,611,822; No. 5,484,457; and No. 3,457,022, incorporated herein by reference.

U.S. Pat. No. 5,611,822 describes a method of introducing a non-oxidizing gas into a chamber in order diminish or remove oxidizing agents in commercial indigo dyeing. The indigo dyed fibers of U.S. Pat. No. 5,611,822 can be natural or synthetic and include fibers in the form of garments or fabric, however the commercial dye apparatuses may need to be modified to provide a near airtight enclosed compartment capable of maintaining a non-oxidized atmosphere.

U.S. Pat. No. 5,484,457 illustrates another indigo dyeing method for textiles including nonwovens consisting of cellulosic blends. This particular method utilizes a water-soluble binder pervious to the application of the indigo dye. This is believed to be disadvantageous to durable coloration as some of the indigo dye can wash off to expose undyed areas or give otherwise poor fastness properties to the fibers.

U.S. Pat. No. 3,457,022 discloses a method of dyeing cotton yarn wherein the yarn is introduced to an indigo vat dye and then skyed or raised out of the dye and exposed to the air, but ultimately, once the yarn has been dyed to it's desired shade, the yarn must be woven into a fabric. This entire process is complicated and time consuming.

It is known to those skilled in the art, when dyeing yarn it is necessary to reduce the dyestuff in a solution of caustic soda, an alkali, and sodium hydrosulfite that then changes the dyestuff form from an insoluble paste to a soluble "leuco". Leucos are those chemicals containing carbonyl groups, wherein the carbonyl groups become carboxyl groups in the presence of a reducing agent. When exposed to the caustic soda, the insoluble paste becomes a solution of sodium derivatives. The material is introduced to the solution and then skyed, or exposed to air. In the presence of air the solution is converted back to its insoluble stage and locks into the fabric as an indigo colored dye.

Conventionally, cotton yarns (usually in groups of 100 or so ends) are roped together and run through a large vat of this reduced indigo with several dips and nips. Once the yarn exits the vat, it is often squeezed and raised upwards (called skying) to allow the oxygen in the air to change the leuco back to the insoluble indigo dye. The shade is pale blue at this first stage. For deeper shades, another dyetank is used to repeat the imbuing, squeezing, and skyeing. Several of these tanks are placed sequentially to give anywhere from 2–3 dips for a light chambray, up to 8 dips for a dark denim shade. The yarns are rinsed, dried, and then merged together and slashed with a warp size agent and then beamed on a warp for weaving.

The production of nonwoven fabrics from staple fibers is known to be more efficient than traditional textile processes as the fabrics are produced directly from the carding process. Nonwoven fabrics are suitable for use in a wide variety of applications where the efficiency with which the fabrics can be manufactured provides a significant economic advantage for these fabrics versus traditional textiles. Hydroentangled fabrics have been developed with improved properties that are a result of the entanglement of the fibers or filaments in the fabric providing improved fabric integrity. U.S. Pat. No. 3,485,706, to Evans, hereby incorporated by reference, discloses processes for effecting hydroentanglement of nonwoven fabrics.

Most nonwoven fabrics are dyed either with pigments and binder systems, continuous, range dyed, printed, or jet dyed. This invention discloses a method for using a durable nonwoven fabric with a cellulosic content, preferably cotton, and running it through the same dyeing process as the yarn and getting a fabric with the same shade and visual aesthetics, but does not have to be slashed, warped, woven, or desized as seen with the prior art. Prior art signifies the need for a more rapid technique of creating indigo dyed fabrics. The present invention allows for rapid production of indigo dyed nonwoven fabrics and is beneficial to various industries since the resultant product is a roll good.

SUMMARY OF THE INVENTION

It is the objective of the present invention to disclose a method of continuously dyeing durable nonwoven fabrics, and more specifically, nonwoven fabrics comprising a cellulosic fibrous material dyed with indigo dyestuffs.

To craft a durable web for indigo dyeing, the contributory factors of the fibers aide to enhance the webs uniformity, integrity, and strength. To obtain such characteristics in a dyeable nonwoven fabric, the web contains a fibrous blend of synthetic and cellulosic fibers that can be carded with one another. A card, known to those skilled in the art as a fiber orientation device, will comb the fibrous blend, thus aligning the fibers in a unidirectional manner. Once the fibrous blend has been carded, the fibers are consolidated into a web that is interlocked or bonded, by those technologies known to those skilled in the art, to form a nonwoven fabric.

Bonding technologies that may be applied, but are not meant to limit the present invention, include adhesive bond, calender bond, through-air bond, needlepunched, or hydroentanglement. Each bonding technology has it's own attributes to the resultant nonwoven fabric. Depending on the desired characteristics of the nonwoven fabric, the choice of bonding techniques may vary.

Following the formation of the nonwoven fabric, the fabric is wetted out, padded, and continuously introduced into one or more indigo dye vats, depending on the desired shade of indigo dyestuff. In between the number of vats containing indigo dye in a leuco state, the fabric is skyed, (i.e. it is raised out of the vat so that it is exposed to the air) allowing for oxidation of the leuco form. The fabric is skyed after each immersion into the indigo dyestuff. The excess dye is removed and the fabric must then be dried. Once the indigo dyed nonwoven fabric is dried, the resultant end product is collected in the form of roll goods.

It is in accordance with the present invention that the formed nonwoven fabric can be immediately wound and taken offline and unwound to be continuously indigo dyed. It is also within the purview of the present invention that the nonwoven fabric is continuously formed and dyed inline with an indigo vat dye.

DETAILED SUMMARY OF THE INVENTION

While the present invention is susceptible of embodiment in various forms, hereinafter is described a presently preferred embodiment of the invention, with the understanding that the present disclosure is to be considered as an exemplification of the invention, and is not intended to limit the invention to the specific embodiment illustrated.

It is in accordance with the present invention, to utilize synthetic fibers in combination with natural or cellulosic fibers in the formation of a nonwoven web. The synthetic fibers may be selected from a group of polyamides, polyesters, or polyolefins, such as polypropylene or polyethylene, their derivatives, and combinations thereof. The synthetic fibers of the present invention may also include any fibers with multi-component configurations, such as side-by-side or sheath-core, as well as geometric variations. The natural fibers of the present invention are cellulosic in nature such as cotton, wood pulp, or rayon. The natural fibers, preferably cotton, make up at least 10% of the fibrous nonwoven fabric.

Cotton fibers are routinely utilized within the textile industry. These fibers provide a fabric with a desired softness and drapeability. Cotton fibers also contribute to the strength of a fabric in addition to being especially susceptible to dyes. The blending of cotton fibers, by ten percent or more, with a selected group of synthetic fibers, such as polyester, result in a nonwoven fabric that is durable and has an affinity to indigo dye.

Figure 1:
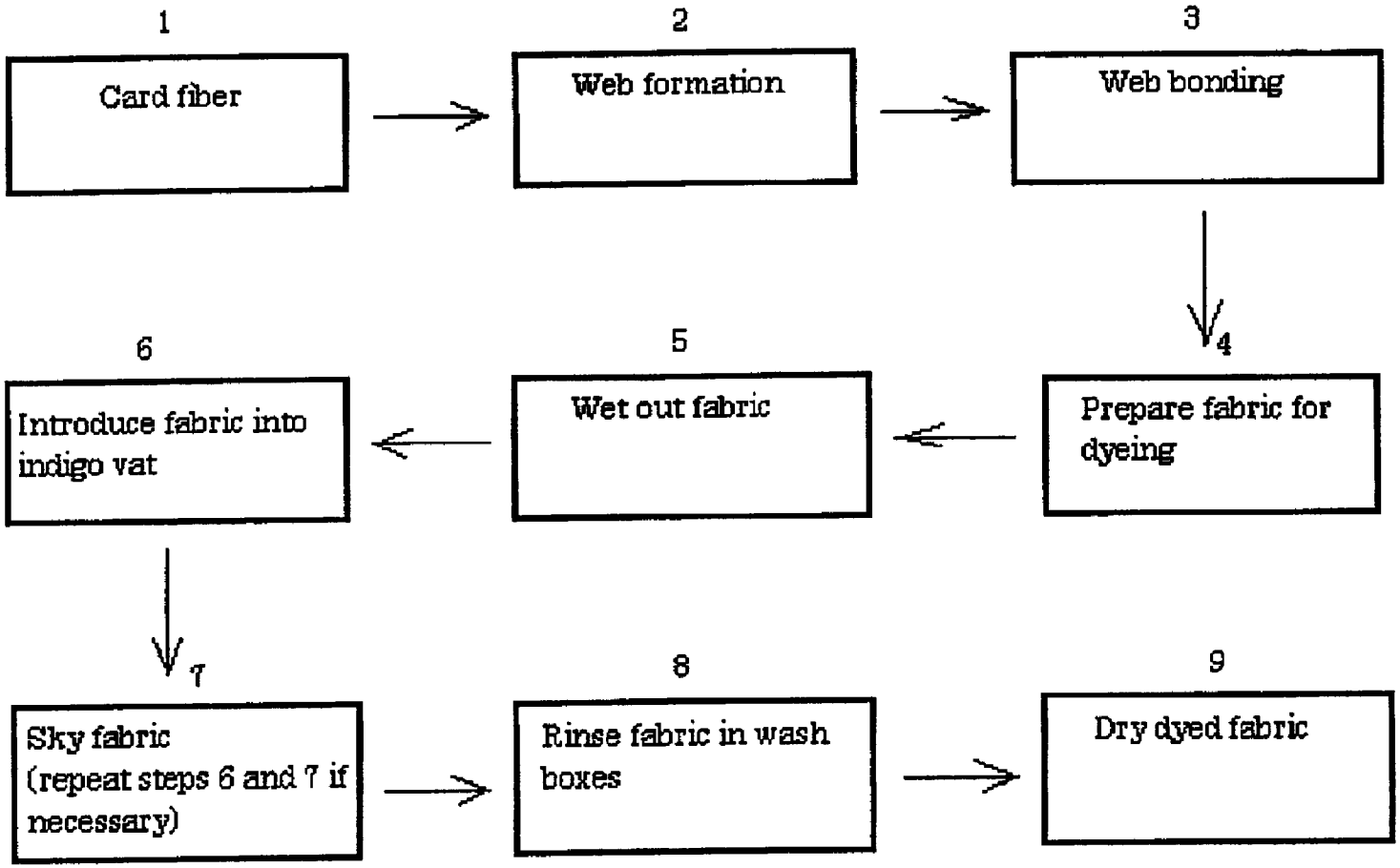
FIG. 1 is a flow chart of the continuous nonwoven forming and indigo dyeing process.

In reference to FIG. 1 the process of continuously dyeing nonwovens is initiated by carding 1 the selected natural and synthetic fibers. The carded fibrous blend must be oriented into a web 2 and then interconnected by suitable bonding means 3. The nonwoven fabric of the present invention may be bonded using any one of the following representative bonding techniques; adhesive bond, thermal point bond, through-air bond, needlepunch, hydroentanglement, or a combination thereof. Thermal point bonding a nonwoven web entails passing the web or layers of webs between two hot metal rolls, one of which has an embossed pattern to impart and achieve the desired degree of point bonding, usually on the order of 10 to 40 percent of the overall surface area being so bonded. The nonwoven web may be through-air bonded wherein the web is passed over a perforated drum and hot air is forced through the web, interlocking the fibers. Needlepunching is another bonding technique that involves passing the fibrous nonwoven web under a series of oscillating needles. The needles operate from the top and/or the bottom of the web, working at rapid speeds to drive the fibers through the web, causing the web to become entangled. The use of water jets, known as hydroentanglement, can also be used as a method of bonding. The web can undergo single or double-sided hydroentanglement wherein the web is exposed to a series of beams dispensing high-speed water jets that act to interlock the fibers, forming a nonwoven fabric.

It is in accordance with the present invention that the formed nonwoven fabric can be immediately wound and taken offline and unwound to be continuously indigo dyed. It is also within the purview of the present invention that the nonwoven fabric is continuously formed and dyed inline with an indigo vat dye.

Figure 2:
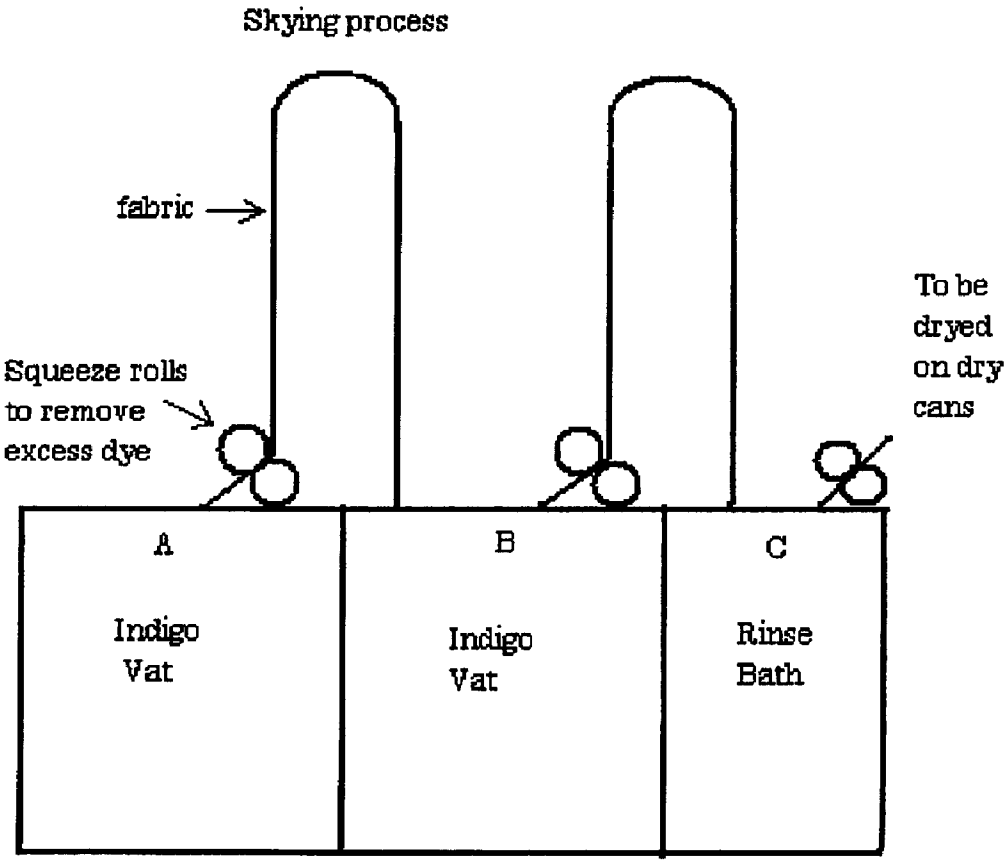
FIG. 2 is a view of the skyeing process.

The nonwoven fabric is pre-wetted 5 and then sent through a set of top rollers and bottom rollers positioned inside the dye tanks 6. The fabric gets saturated with the indigo dyestuff while being passed through the rollers of the tanks. The excess dye is removed as the nonwoven fabric progresses through a set of squeeze rollers. Once the nonwoven fabric is removed of the excess vat dye, it is skyed as depicted in FIG. 2, in order to set and lock the dye into the nonwoven fabric. The nonwoven fabric may be conveyed through numerous dye tanks in order to acquire a deeper indigo shade.

The indigo dyed nonwoven fabric must be sent through a plurality of water tanks to be rinsed after the desired shade has been achieved. Once rinsed, the nonwoven fabric proceeds into a drying system, such as steam operated dry cans, in order to dry the rinsed indigo dyed nonwoven fabric. After the fabric has been dried, the resultant indigo dyed nonwoven fabric can optionally have an additional finish applied; such finishes be added to affect wash durability, water resistance, flame retardency, or hand modifications.

The fabric of the present invention can be used for such commercial applications as apparel, bedding, industrial, and other commercial applications.

The preferred continuously formed and indigo dyed nonwoven fabric has a basis weight range of about 3–8 ounces per square yard with a most preferred basis weight of 4.5–5.5 ounces per square yard. In one embodiment of the invention, the nonwoven fabric is comprised of a fibrous blend of 60% cotton, 30% nonoptically brightened PET and 10% of a PET derivative (PETG). The nonwoven fabric comprising the previously mentioned fibrous blend was indigo dyed, rinsed, dried, and wound as roll goods.

Test Procedures

Strip Tensile Test (D 5035)

This test is meant to measure the breaking strength of the fabric in units of either grams or pounds as well as measures the elongation of the fabric.

Crockfastness (AATCC TM8-1988)

This test may be preformed with a wet or dry sample. The sample is rubbed against a testing surface for a designated number of passes. Test results are rated on a scale of 1–5, where a rating of 5 indicates the lack of color transfer.

Wash Durability (D 2747)

A heavy-duty automatic washer is used to test a samples was durability. The sample is run through a complete cycle consisting of wash-spin-rinse-spin. The sample is given an acceptable, minimum, or hold rating.

The results for the tested continuously formed and dyed nonwoven fabric, as provided in Table 1, indicate an acceptable wash durability after 25 complete washes and a top rating of 5 for crockfastness when tested under both wet and dry conditions. Test results reveal a durable, indigo dyed nonwoven fabric suitable for use in industrial, appeal, bedding, and other commercial applications.

TABLE 1

| Tests Performed | Units | Continuous Indigo Dyed Nonwoven Fabric Sample |
|---|---|---|
| Basis Weight | (oz./yd$^2$) | 5.25 |
| Bulk | (mils.) | 34.5 |
| MD Strip Tensile | (lbs.) | 39.28 |
| MD Elongation | (%) | 31.99 |
| MD Cantilever Bend | (cm) | 14.6 |
| Wash Durability | | 25 washes Acceptable |
| Crock - dry | rated 1–5 | 5 |
| Crock - wet | rated 1–5 | 5 |

What is claimed is:

1. A process of continuously dyeing a nonwoven fabric, comprising the steps of:

a. providing a nonwoven fabric comprising staple length fibers, the staple length fibers including at least 10% natural fiber;

b. wetting said nonwoven fabric;

c. dyeing said wetted nonwoven fabric with a leuco indigo vat dye;

d. skying said dyed nonwoven fabric;

e. rinsing said dyed nonwoven fabric;

f. drying said nonwoven fabric;

g. said indigo dyed nonwoven fabric having a crock fastness, per AATCC TM 8-1988, of at least 5.

2. A process of continuously dyeing a nonwoven fabric as in claim 1, wherein said fibrous blend comprises synthetic and natural fibers.

3. A process of continuously forming and dyeing a nonwoven fabric as in claim 2, wherein said synthetic fibers are selected from the group consisting of polyamides, polyester, polyolefins, and the combinations thereof.

4. A process of continuously dyeing a nonwoven fabric as in claim 2, wherein said natural fibers are selected from the group consisting of cotton, wood pulp, rayon and the combinations thereof.

5. A process of continuously dyeing a nonwoven fabric as in claim 4, wherein said natural fiber is cotton.

6. A process of continuously dyeing a nonwoven fabric, comprising the steps of:

a. providing a fibrous blend comprising staple length fibers, the staple length fibers including at least 10% natural fibers;

b. carding said fibrous blend;

c. forming said fibrous blend into a fibrous batt;

d. bonding said fibrous web to form a nonwoven fabric;

e. wetting said nonwoven fabric;

f. dyeing said wetted nonwoven fabric with a leuco state indigo vat dye;

g. skying said dyed nonwoven fabric;

h. rinsing said dyed nonwoven fabric;

i. drying said nonwoven fabric; and j. said indigo dyed nonwoven fabric having a crock fastness, per AATCC TM 48 -1988, of at least 5.

* * * * *